US005226274A

United States Patent [19]

Sommerstein

[11] Patent Number: 5,226,274

[45] Date of Patent: Jul. 13, 1993

[54] PANEL MOUNTING CLIP

[76] Inventor: Michael Sommerstein, 75 Green Acres Road, Thornhill, Ontario, Canada, L4J 4S2

[21] Appl. No.: 712,691

[22] Filed: Jun. 10, 1991

Related U.S. Application Data

[63] Continuation of Ser. No. 318,066, Feb. 22, 1989, abandoned.

[51] Int. Cl.[5] ..... E04B 1/38

[52] U.S. Cl. ..... 52/512; 52/509; 52/511; 52/713; 52/764

[58] Field of Search ..... 52/509, 511, 512, 713, 52/480, 481, 489, 764, 766

[56] References Cited

U.S. PATENT DOCUMENTS

| | | | |
|---|---|---|---|
| 2,007,842 | 7/1935 | Whiteside . | |
| 2,389,171 | 11/1945 | Urbain | 52/489 |
| 2,926,742 | 3/1960 | Fischer | 52/489 |
| 3,264,793 | 8/1966 | Schlensker | 52/511 |
| 3,342,005 | 9/1967 | Richards et al. | 52/509 |
| 3,346,282 | 10/1967 | Yarborough | 52/713 |
| 3,986,313 | 10/1976 | Nelsson | 52/481 |
| 3,990,205 | 11/1976 | Davis . | |
| 4,070,835 | 1/1981 | Reverend et al. . | |
| 4,261,153 | 4/1981 | Haines, Jr. et al. . | |
| 4,567,706 | 2/1986 | Wendt . | |
| 4,685,263 | 8/1987 | Ting . | |

*Primary Examiner*—Michael Safavi
*Attorney, Agent, or Firm*—Bacon & Thomas

[57] ABSTRACT

A clip for mounting a panel which comprises a first clipping member and a second clipping member. The first clipping member is attached to a panel adjacent to an edge of the panel and the second clipping member is secured to a building structure. The first and second clipping members have a male member and a female member for receiving therein the male member thereby slidably to interengage the clipping members to secure the panel to the building structure. The male member has a stepped distal edge so that the male member is snugly received within the female member.

4 Claims, 4 Drawing Sheets

PANEL MOUNTING CLIP

This application is a continuation of U.S. application Ser. No. 07/318,066, filed Feb. 22, 1989 now abandoned.

This invention relates to a clip for mounting a panel to a support surface, such as for mounting a wall panel to a wall of a building. In particular, the invention relates to such a clip which is accessible once the panel has been installed and in which a panel held by the clip may be readily detached.

U.S. Pat. No. 2,007,842 (Whiteside) discloses a two-part clip for mounting tile monoliths. The clip comprises two shaped and cooperating clip members one of which extends between spaced angle flanges which are secured to suitable supports adjacent the wall to be covered with the clip member projecting in front of and parallel to the wall. The second clip member is secured to the tile monolith and is simply hooked over the first clip member to support the tile monolith in position This clip has a number of inherent disadvantages. One disadvantage is that the clip members are disclosed as extending only horizontally. Furthermore, once installed, the clip is not accessible.

U.S. Pat. No. 4,070,835 (Reverend et al.) discloses another clipping system for mounting wall panels. The clipping system comprises an upper and a lower set of panel bearing elements which each have means for being secured to a wall panel. An elongated one-piece structural element has a main web, a first longitudinal groove disposed on one side of the main web, and a pair of upper and lower second longitudinal grooves disposed on the opposite side of the main web. The first longitudinal groove is hooked on a support member in longitudinally adjustable relation, while each second groove longitudinally receives one of the set of panel bearing elements. The upper second longitudinal groove receives the lower set of panel bearing elements of an upper panel, and the lower second longitudinal groove receives the upper set of panel bearing elements of a next lower panel. The clipping system has the same inherent disadvantages as the clip disclosed in U.S. Pat. No. 2,007,842.

U.S. Pat. No. 4,261,153 (Haines et al.) discloses an accessible, detachable, support system for wall panelling. The system comprises three parts, namely, a clip member, a support member and a vertical spline. The clip member is J-shaped and has raised portions for engaging the support member. The support member is secured to a support surface of a building and has a flange which engages under one of the raised portions of the clip member. The reflexly bent end of the clip member engages the vertical spline to slidably hold the vertical spline. The wall panel is then attached to the vertical spline. Because the vertical spline may slide in the clip member, the panel attached to the vertical spline may be slid out of position to provide access to the clip system. However, because the system comprises three parts, it is more complicated than necessary and therefore more expensive to manufacture and difficult to install.

Accordingly, it is an object of this invention to provide a clip which is simple, accessible once a panel has been installed, may support a panel on all four edges, and is adjustable.

In one aspect, this invention provides a clip for mounting a panel and comprising a first clipping member and a second clipping member. The first clipping member is adapted to be attached to a panel adjacent an edge thereof, and the second clipping member is adapted to be attached to a building structure. One of the clipping members has a male member and the other of the clipping members has a female member for receiving therein the male member, thereby slidably to interengage the clipping members for securing the panel to the building structure. The male member has a stepped distal edge which is snugly receivable within the female member.

In another aspect, this invention provides a clip for mounting a panel and comprising a first clipping member and a second clipping member. The first clipping member is adapted to be attached to a panel adjacent an edge thereof, and the second clipping member is adapted to be attached to a building structure. One of the clipping members has a male member and the other of the clipping members has a female member for receiving therein the male member, thereby slidably to interengage the clipping members for securing the panel to the building structure. The second clipping member has a slot which extends in a direction substantially perpendicular to the direction of slidable interengagement between the clipping members and which is adapted to be engaged by an alignment tool to align the panel relative to the second clipping members.

Therefore, this invention provides a clip which is simple, easy and inexpensive to manufacture, and easy to install. The stepped end of the male member according to said one aspect of the invention provides the significant advantage that the male member may be snugly received in the female member without being difficult to insert in the female member. A male member which was of substantially the same thickness or height as the height of the opening in the female member would be more difficult to align with and insert into the female member. Also according to said another aspect of the invention an alignment tool may engage the slot of the second clipping member and the panel to align the panel relative to the second clipping member. This allows alignment of the panel even though it is already engaged by the clip.

Embodiments of the invention are described, by way of example only, with reference to the accompanying drawings in which.

Figure 1:
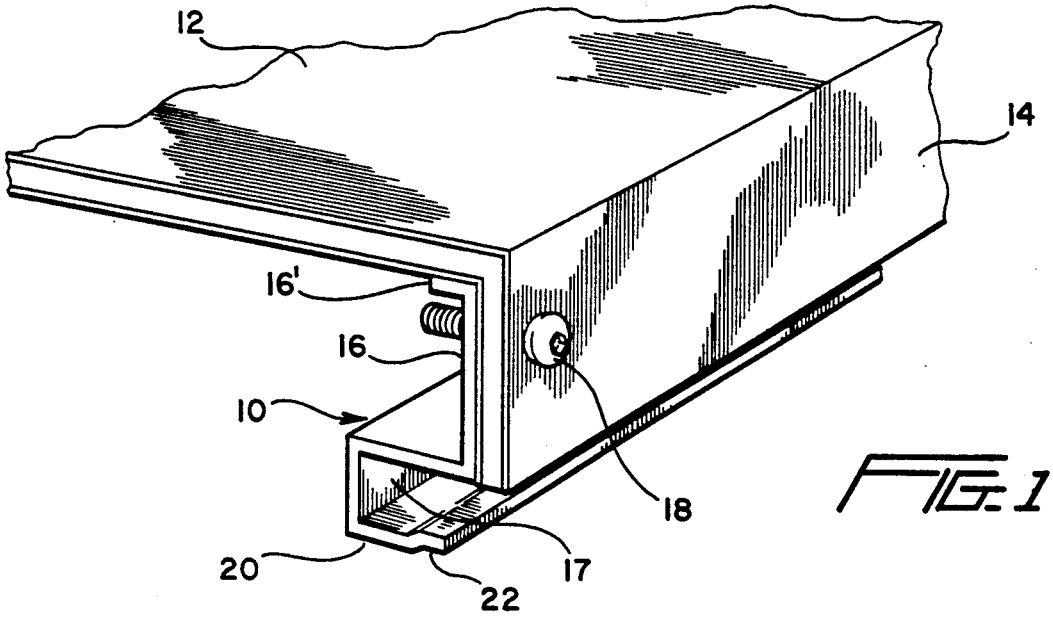
FIG. 1 is a perspective view of a first clipping member of a clip attached to a composite panel.

Referring to FIG. 1, a first clipping member 10 of a clip is attached to a composite panel 12. The composite panel 12 is a three-ply composite panel which has a low density polyethylene core bonded between two sheets of aluminum alloy. The composite panel is sold by the Mitsubishi Corporation of Japan under the trademark "ALPOLIC". Clearly, however, this invention is not limited to a clip for this type of panel and the clip may be used with panels of any suitable form. The first clipping member 10 of the clip is elongated and extends the length of the side of the panel 12 but may also be provided in shorter discrete lengths along the edge of the panel 12.

In the embodiment shown in FIG. 1, the panel 12 is bent at right angles adjacent its edges to provide a panel edge flange 14. The first clipping member 10 comprises a profiled member which is shaped to provide an attachment flange 16 and a channel member 17 at the distal edge of the attachment flange 16. The attachment flange 16 of the first clipping member 10 is secured to the flange 14 of the panel 12 by means of screws 18 with an inwardly bent edge portion 16' of the attachment flange 16 bearing against the inner face of the panel 12 adjacent to the flange 14 thereof. Thus, the first clipping member 10 extends on the inner face of the panel 12 and the flange 14 thereof with the channel member 17 projecting from the flange 14 and facing outwardly of the panel 12. The wall of the channel member 17 remote from the attachment flange 16 forms a male member 20 for engaging within the female opening in a second female clipping member 24 of the clip. The distal edge 22 of the male member 20 is stepped or offset inwardly into the channel member 17 by a small amount, this stepping of the edge 22 of the male member 20 serving to prevent warping thereof and thus to ensure that the male member 20 remains straight.

Figure 4:
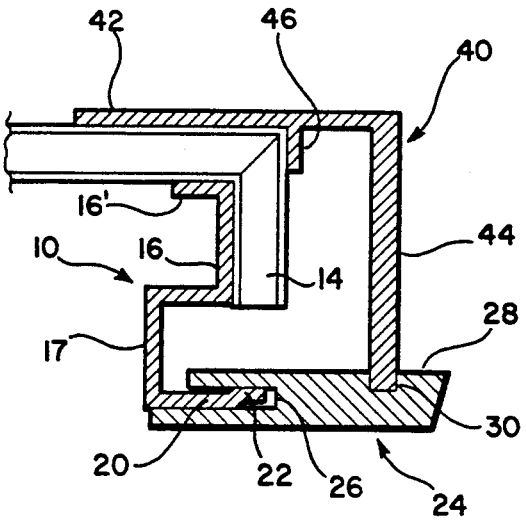
FIG. 4 is a sectioned view illustrating the clip and an alignment tool.
Figure 6:
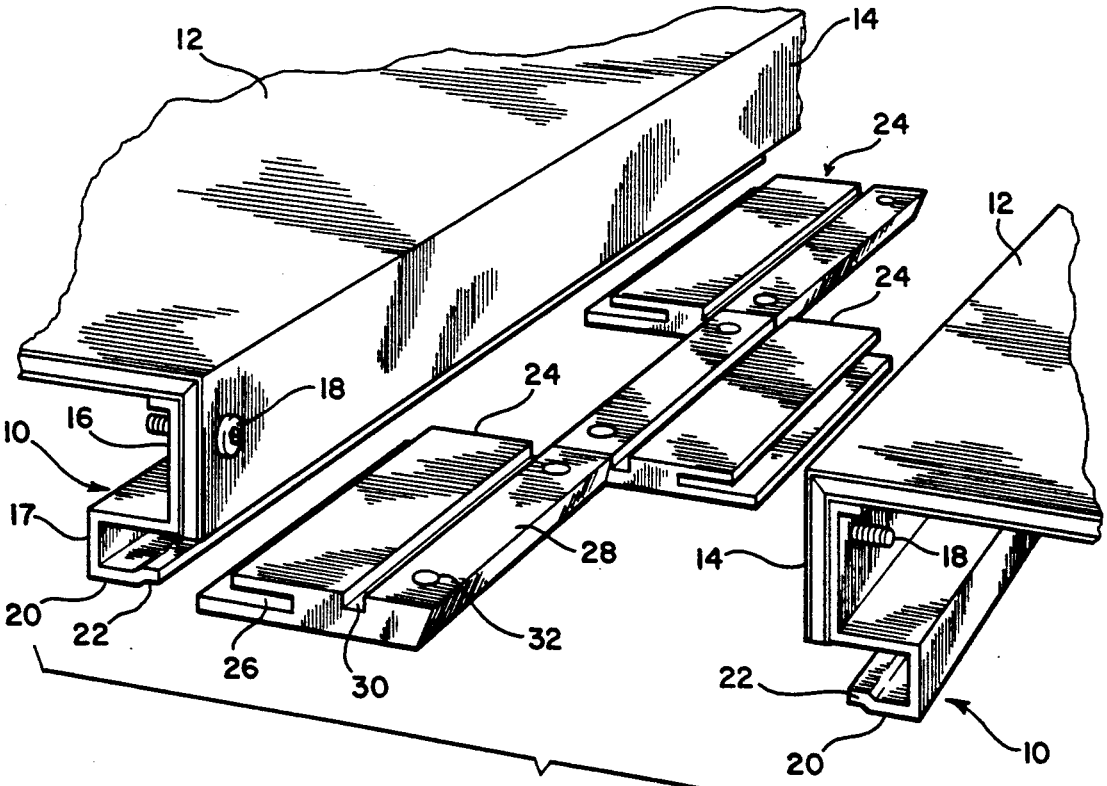
FIG. 6 is a perspective view of a clip illustrating second clipping members alternating to receive adjacent panels.

As is most clearly illustrated in FIGS. 4 and 6, the second clipping member 24 is a short thin member which has an elongate slot opening or channel 26 provided in one side edge thereof. The channel 26 constitutes the female opening for receiving and engaging with the male member 20 of the first clipping member 10. The height H of the channel 26 substantially corresponds to the combined height of the male member 20 so that rattling of the male member 20 within the channel 26 is substantially prevented. The face 28 of the second clipping member 24 has a slot 30 which extends across the face 28 in a direction substantially perpendicular to the direction of slidable interengagement of the clipping members 10 and 24 and parallel to the edge of panel 12. The second clipping member 24 is also provided with holes 32 adjacent the edge opposite to the channel 26. Screws 33 are passed through the holes 32 to secure the second clipping member 24 to a sub-girt 38 (FIG. 8) or the like of a building structure.

Figure 2:
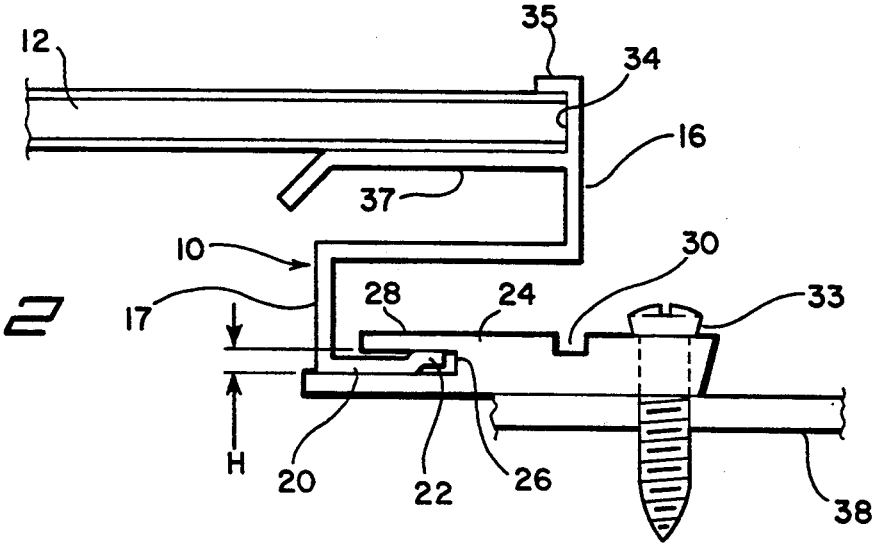
FIG. 2 is a sectioned view of a first clipping member of a clip attached to a composite panel and engaged by a second clipping member.

In a further embodiment illustrated in FIG. 2, the composite panel 12 is not provided with a flange 14. Instead the attachment flange 16 of the first clipping member 10 is provided with a small flange 35 at its proximal end and a gripping flange 37 spaced from the small flange 35 to provide a panel engaging channel 34 which engages around the edge of the panel 12.

Figure 3:
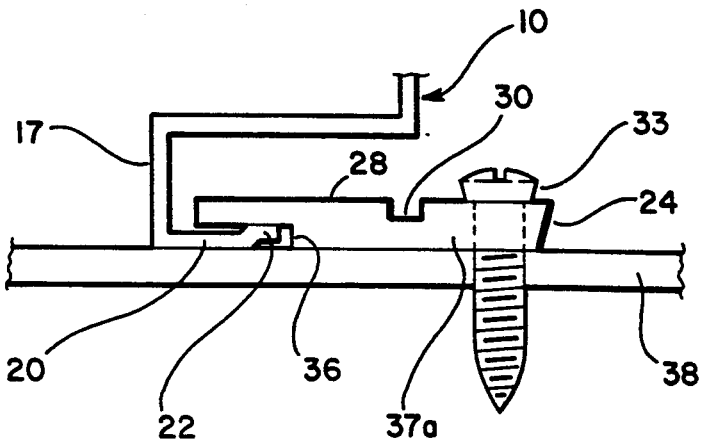
FIG. 3 is a sectioned view of a first clipping member of a clip engaged by a further embodiment of a second clipping member.

In a still further embodiment illustrated in FIG. 3, the second clipping member 24 is not provided with a channel 26, but is instead provided with a recess 36 which is in the face 37*a* opposite to the face 28 and which receives the associated edge of the member 24. When this second clipping member 24 is secured to a sub-girt 38 of a building, the recess 36 forms the female member into which the male member 20 of the first clipping member 10 may be inserted.

In use, the first clipping member 10 is secured to each edge of a panel 12. Then, a plurality of second clipping members 24 are secured to a sub-girt 38 of a building in a position to secure the lower edge, for example, of the panel 12. Generally, the second clipping members 24 are spaced from one another. However, it is clear that a single elongated second clipping member 24 may be provided. The male member 20 of the first clipping member 10, which is attached to the lower edge of the panel 12, is slidably engaged within the female member of the second clipping member 24 to vertically support the panel 12, the insertion of the male member 20 into the female member of the second clipping member 24 being facilitated by the stepped edge 22 of the male member 20. Further second clipping members 24 are then positioned along each of the other edges of the panel 12. As is most clearly illustrated in FIG. 4, an alignment tool 40 is then used to align the panel 12 relative to these second clipping members 24. The second clipping members 24 are then secured to the sub-girts 38. The alignment tool 40 comprises a substantially F-shaped member which has a panel engaging leg 42, a slot engaging leg 44 which projects at right angles from the panel engaging leg 42, and an aligning leg 46 projecting from the panel engaging leg 42 parallel to the leg 44. The panel engaging leg 42 is laid along the outer surface of the panel 12 with the aligning leg 46 engaging the edge of the panel 12. The panel 12 is then moved relative to the second clipping member 24, or vice versa, until the leg 44 engages in the slot 30 in the second clipping member 24. The edge portion 16' of the flange 16 serves as a gauge for attachment of the panel 12 to the first clipping member 10, and operatively serves to transfer wind loading on the panel 12 to the first clipping member 10. The portion 16' of the flange 16 also serve as bracing between the panel 12 and the flange 14 thereof.

Figure 5:
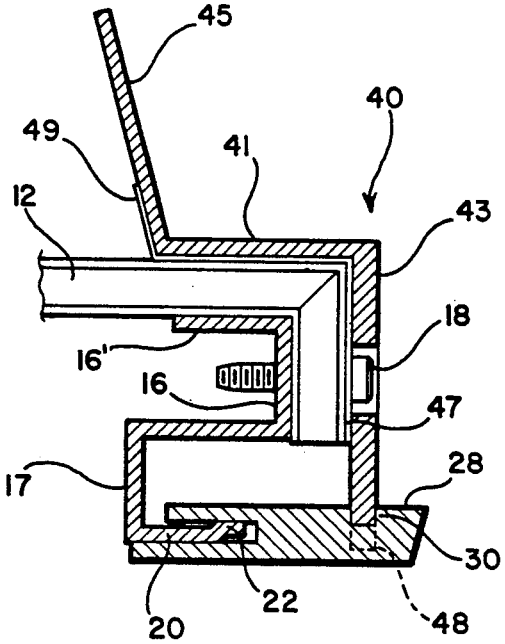
FIG. 5 is a sectioned view illustrating the clip and an alternative form of alignment tool.

FIG. 5 shows an alternative form of alignment tool 40 which comprises a panel engaging leg 41, a slot engaging leg 43, and an inclined handle leg 45, the leg 43 having an elongated slot 47 for accommodating the heads of the screws 18, and the edge of the leg 43 having projecting portions 48 which straddle the second clipping member 24. As in the case of the alignment tool 40 described above with reference to FIG. 4 this form of alignment tool 40 illustrated in FIG. 5 serves properly to position the second clipping member 24 relative to the panel 12, and the portions 48 of the leg 43 serve more securely to hold the second clipping member 24 in position during drilling of the holes in the sub-girt 38 for the screws 33 and fastening of these screws 33. 49 denotes a protective tape the thickness of which is greatly exaggerated in FIG. 5, this tape 49 being applied to the faces of the tool 40 which would otherwise contact the panel 12 when the tool 40 is in use thereby to prevent the tool 40 scratching or otherwise marring the surfaces of the panel 12. Although not shown in FIG. 4 a protective tape corresponding to the tape 49 could likewise be applied to the appropriate faces of the form of alignment tool illustrated in FIG. 4.

Generally, more than one panel 12 is used to cover the side of a building. As most clearly illustrated in FIG. 6, the second clipping members 24 are aligned along the sub-grit 38 in an alternating fashion with the channels 26 of adjacent second clipping members 24 disposed in opposite directions. Adjacent panels 12 are then disposed in position with the first clipping members 10 thereof engaged with the channels 26 of the appropriate second clipping members 24. The second clipping members 24 are shown adjacent one another, but it will be understood that the second clipping members 24 maybe spaced from one another.

Figure 8:
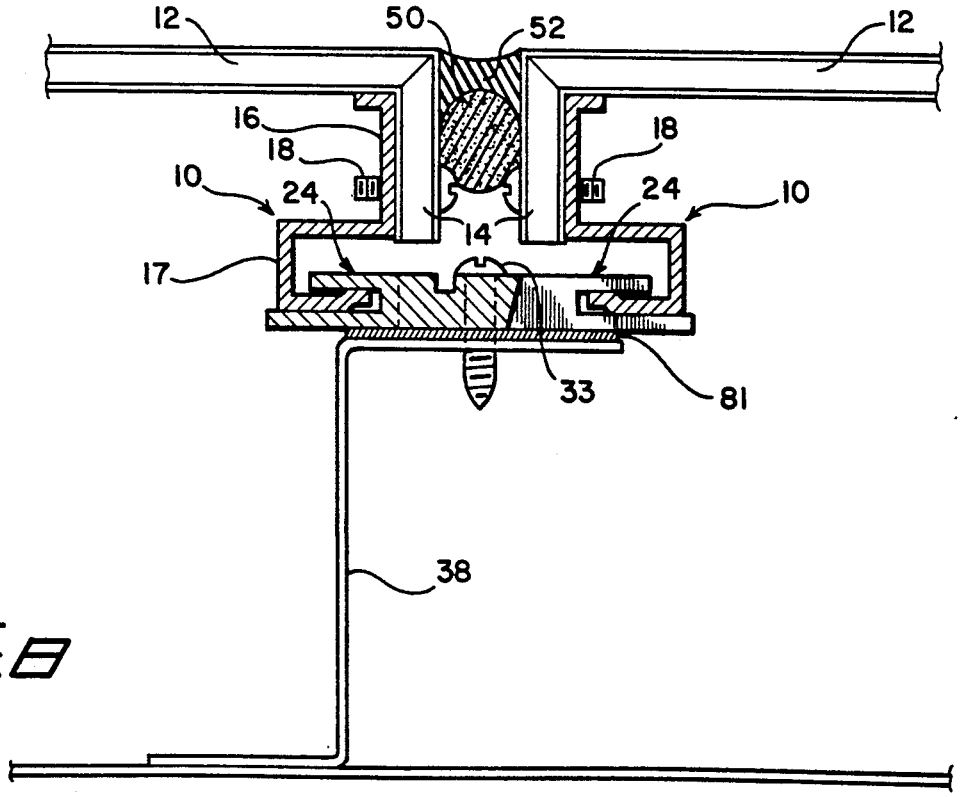
FIG. 8 is a sectioned view of the clip securing two adjacent panels.

Two adjacent panels 12 secured by clips are illustrated in FIG. 8. For insulation purposes, open cell polyurethane foam backers 50 are pushed between the flanges 14 of the adjacent panels 12. Silicone sealant 52 may then be placed over the polyurethane backers 50 to provide a waterproof seal.

Figure 7:
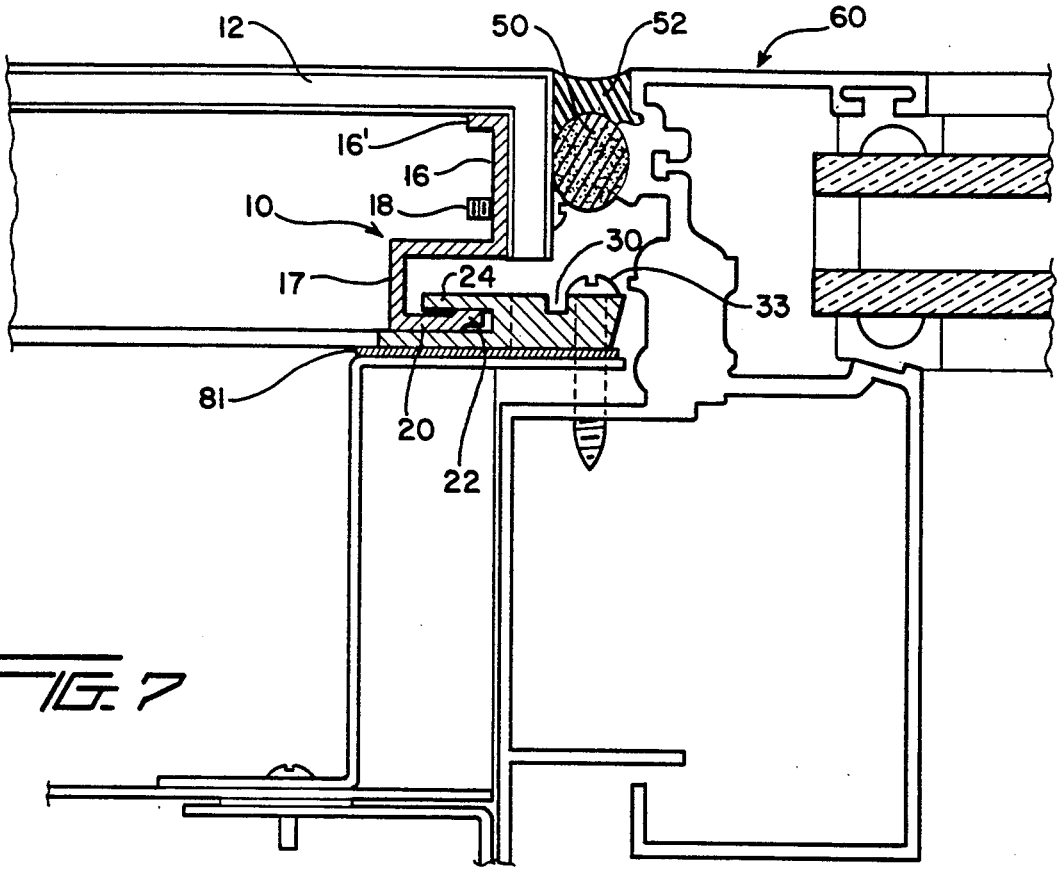
FIG. 7 is a sectioned view of the clip used in a window head.

FIG. 7 illustrates a similar application in which a panel 12 is secured adjacent a window profile 60 by means of a clip. Again polyurethane backers 50 are pushed between the flange 14 of the panel 12 and the window profile 60. Silicone sealant 52 is placed over the polyurethane backers 50. In this case the panel 12 is held by the clip but not the window profile 60. Along the bottom edge of the lowermost panel 12 there is preferably a single, continuous second clipping member 24 and spaced weep hole 39 (shown in FIG. 3) may be provided in the wall of the channel member 17 opposed to the male member 20. Likewise, along the outermost vertical edge of each side panel 12 there is preferably a single, continuous second clipping member 24.

In FIGS. 7 and 8 there is illustrated the provision of a separation tape 81 between the second clipping member 24 and the sub-girt 38 thereby to provide thermal insulation therebetween, and also to prevent electrolytic action between the second clipping member 24 which is preferably of aluminum and the sub-girt 38 which is preferably of steel, the thickness of the tape 81 being greatly exaggerated in FIGS. 7 and 8.

Figure 9:
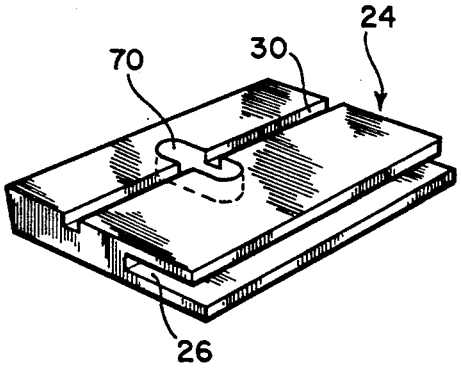
FIG. 9 shows a further embodiment of a second clipping member of the clip.

FIG. 9 illustrates a further embodiment of a second clipping member 24. In this embodiment, the second clipping member is provided with a hole 7 which is elongated in the direction of slidable interengagement between the clipping members 10 and 24 i.e. transversely to the slot 30, and which, as shown, may intersect the slot 30. This embodiment offers the additional advantage that the position of the second clipping member 24 may be adjusted by merely loosening the screw 33 which holds it to the sub-girt 38 and moving the second clipping member 24. Clearly, the screw 33 need not be removed. Only one elongated hole 7 is shown but it will be understood that a plurality of holes 70 may be provided in each second clipping member 24, preferably such a hole 70 adjacent to each end of the slot 30.

Figure 10:
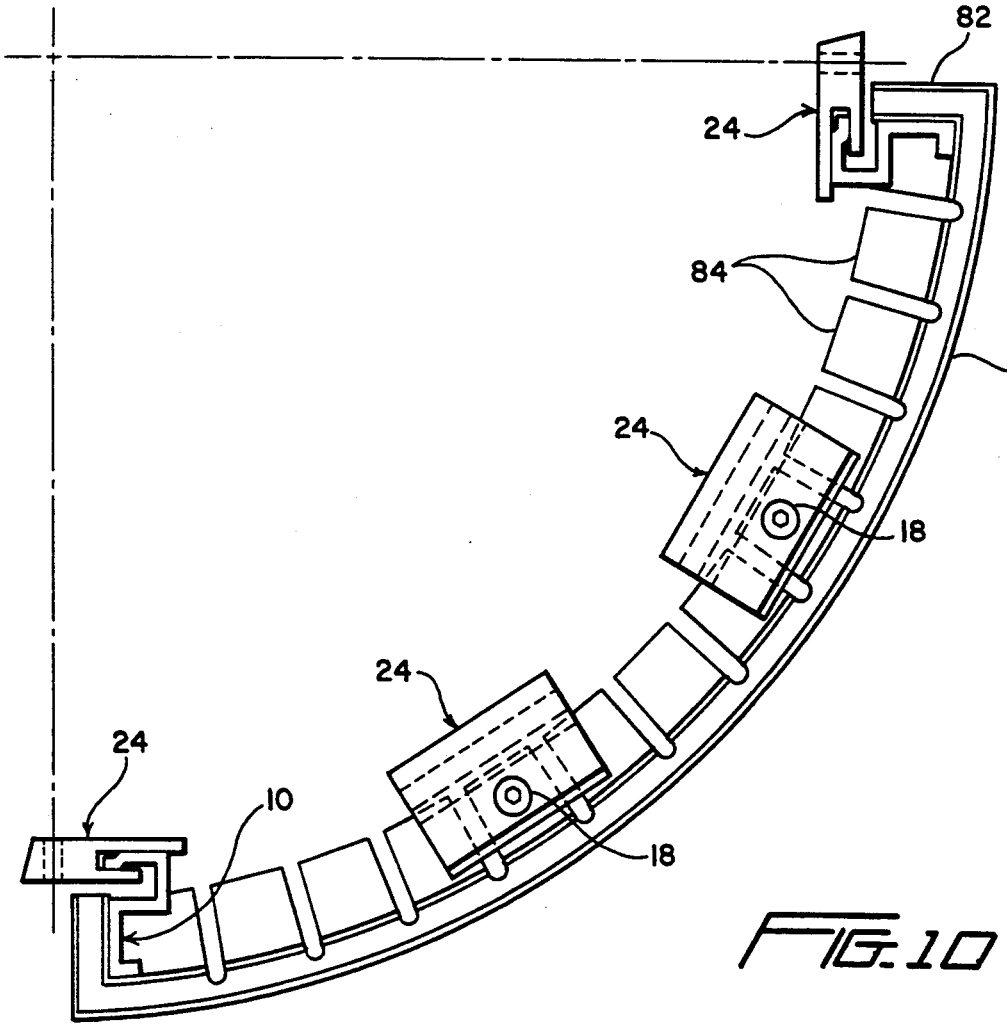
FIG. 10 is a sectioned view illustrating the clips supporting a curved panel.

FIG. 10 illustrates a curved panel 80 secured by means of the clips. The two side edge flanges 82 of the panel 80 are secured to first clipping members 10 which engage second clipping members 24. The lower and upper edges of the panel 80 are provided with slotted flanges 84. Clearly, the flanges are slotted in order to facilitate bending of the panel 80. The first clipping member 10 of each clip for securing these lower and upper edges of the panel 80 is not elongated, but is approximately of the same length as the second clipping member 24. Alternatively, a curved elongate first clipping member 10 may be provided for each curved edge.

Figure 11:
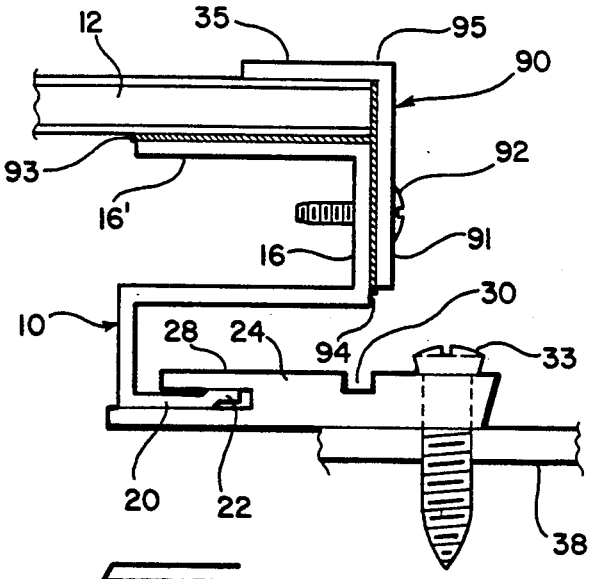
FIG. 11 is a view corresponding to FIG. 2 but showing an alternative embodiment.

FIG. 11 shows a further embodiment corresponding to the embodiment hereinbefore described with reference to FIG. 2, but in which the first clipping member 10 corresponds in form to the first clipping member 10 hereinbefore described with reference to FIG. 1, and the flange 35 constitutes a limb of an L-shaped member 90 the other limb 91 of which is secured by screws 92 to the flange 16 of the first clipping member 10. Adhesive tape 93 may be provided between the portion 16' of the flange 16 and the panel 12, with butyl tape 94 on the limb 91 of the L-shaped member 90. Weep holes 95 may be provided in the limb 35 of the member 90 adjacent to the limb 91 thereof.

To remove the panel 12 the screws 33 which secure the second clipping member 24 to the sub-girt 38 are removed and a tool such as a screwdriver or, for example, the alignment tool 40 shown in FIGS. 4 or 5 is engaged with the slot 30 of the second clipping member 24 which is then pried aside thereby to disengage the female member constituted by the channel 26 of the second clipping member 24 from the male member 20 of the first clipping member 10. The panel 12 may then be removed. Where the second clipping member 24 is in accordance with the embodiment illustrated in FIG. 9 it will be appreciated that in the above-described procedure for removal of the panel 12 the screws 33 need not be removed but need merely be loosened since the elongated form of the hole or holes 70 permit the second clipping member to be pried aside.

It will be understood that numerous variations may be made to the described embodiments without departing from the scope of the invention as set forth in the claims. For example, the first clipping member 10 of the clip may be provided with the female member, with the second clipping member 24 being provided with the male member for slidingly engaging the female member. Also, the distal edge 22 of the male member 20 may be stepped away from the channel 17 rather than into it.

I claim:

1. A clip for mounting a panel and comprising:

a first clipping member including means for attaching the first clipping member to a panel adjacent an edge thereof;

a second clipping member adapted to be attached to a building structure and including a lower surface adapted to lie adjacent the building structure and an upper surface facing said means for attaching the first clipping member to a panel adjacent an edge thereof;

one of the clipping members having a male member and the other of the clipping members having a female opening for slidably receiving therein the male member, said male member and female opening arranged to slidably interengage each other in a direction substantially parallel to the plane of a panel engaged by the first clipping member;

the second clipping member including a channel in said surface facing the panel attaching means of the first clipping member, said channel extending in a direction substantially perpendicular to the direction of slidable interengagement between the male and female member and opening, respectively, and being adapted to be engaged by an alignment tool to align a panel edge relative to the second clipping member in said direction of slidable interengagement.

2. A clip according to claim 1 wherein said first clipping member comprises said male member and said second clipping member comprises said female member.

3. A clip according to claim 2, wherein said second clipping member includes an edge and said opening is disposed in said edge, and said male member comprises an edge portion of said first clipping member.

4. A clip according to claim 1, wherein said second clipping member includes an edge facing said male member, and a recess in said lower surface adjacent said edge, said recess constituting said female opening when said second clipping member is attached to a building structure.

* * * * *